United States Patent [19]

Hiromori et al.

[11] Patent Number: 4,648,587

[45] Date of Patent: Mar. 10, 1987

[54] FLAT ARTICLE FEEDING APPARATUS

[75] Inventors: Kunio Hiromori; Masahiko Noguchi, both of Tokyo, Japan

[73] Assignee: NEC Corporation, Japan

[21] Appl. No.: 593,479

[22] Filed: Mar. 26, 1984

[30] Foreign Application Priority Data

Mar. 24, 1983 [JP] Japan ..... 58-49578

[51] Int. Cl.[4] ..... B65H 5/08

[52] U.S. Cl. ..... 271/12; 271/94; 271/96

[58] Field of Search ..... 271/3.1, 5, 6, 7, 10, 271/11-13, 94, 96, 116, 178, 314

[56] References Cited

U.S. PATENT DOCUMENTS

| | | | |
|---|---|---|---|
| 3,025,052 | 3/1962 | Gutteling | 271/94 |
| 3,604,702 | 9/1971 | Katagiri et al. | 271/5 |
| 3,635,463 | 1/1972 | Stobb | 271/3.1 |

*Primary Examiner*—Duane A. Reger

*Assistant Examiner*—Matthew C. Graham

*Attorney, Agent, or Firm*—Laff, Whitesel, Conte & Saret

[57] ABSTRACT

A flat article feeding apparatus has a stacker for accumulating a plurality of flat articles, in a standing state. A main suction chamber is arranged to confront a side of the flat articles which accumulate in the stacker. A perforated suction belt moves around the main suction chamber for picking up the flat article, one by one. A pair of confronting transfer belts transfer the flat articles within a pinch of the confronting belts, as they are delivered from the suction belt. An intake belt is positioned between the suction belt and the transfer belts. The intake belt flares outwardly to form an angle $\theta$, with respect to the flat artcle transfer direction. Fins are mounted on a roller which supports the intake belt in order to guide the oncoming flat articles carried by the belt. The speed $V_1$ of the intake belt or fins is set at $(V/\cos\theta)$ with respect to the transfer speed $V_2$ of the flat article.

8 Claims, 3 Drawing Figures

FLAT ARTICLE FEEDING APPARATUS

BACKGROUND OF THE INVENTION

This invention relates to an apparatus for handling flat articles, such as an envelope and a postcard, and more particularly, to a flat article feeding apparatus which successively feeds flat articles from a stacker, one by one.

In a conventional flat article feeding apparatus, a suction chamber is arranged at a position confronting flat articles which are accumulated in a stacker. An endless suction belt, having pierced holes, is driven around the suction chamber to pick up the flat articles, one by one, from the stacker. The flat article thus picked up is caught in the nip and pinched between a pair of transfer belts aligned with and confronting the output end of the suction belt.

The construction of such a conventional flat article feeding apparatus is schematically disclosed, for example, in U.S. Pat. No. 3,604,702, and particularly in its FIG. 2. In the disclosed feeding apparatus, an entrance space at the front of the pair of transfer belts is enlarged to ensure receiving the flat articles as they are delivered from the suction belt. Such a structure of the transfer belts is advantageous in that, even if there is a bent tip on the fed flat article delivered from the suction belt, the fed flat article can be pinched securely between the pair of the transfer belts.

The conventional flat article feeding apparatus, however, is defective in the following respects. In general, the suction belt and transfer belts are driven at a certain constant speed at which the flat article is transferred. On the other hand, as described above, in order to pinch the fed flat article accurately, the entrance space of the transfer belts is enlarged. For example, one of the pair of transfer belts is opened at a certain angle with respect to the transfer direction as shown in FIG. 2 of U.S. Pat. No. 3,604,702. Assuming that the transfer speed is V and the angle if $\theta$, of the one opened belt at the entrance of the transfer belt, a speed of transfer direction component of the opened belt is represented by $V \cos \theta$, which is surely smaller than V. As a consequence, when the flat article is delivered from the suction belt driving at the transfer speed V, and if its leading tip end is bent, and the tip collides against the opened belt of the transfer belts, a large pressure is exerted on the leading end or tip of the flat article due to the difference between its speed V and the opened belt's speed $V \cos \theta$ in the transfer direction component. This is apt to cause a mutiliation of the article, a misoperation, and a jam.

SUMMARY OF THE INVENTION

It is, therefore, an object of the invention to provide a flat article feeding apparatus which can securely feed out a flat article without mutilating it, causing a misoperation, and a jam, even when the flat article is bent at its leading end or tip.

According to the invention, a flat article feeding apparatus has a stacker for accumulating flat articles, in a standing state. A main suction chamber confronts the sides of the flat articles as they are accumulated in the stacker. A perforated suction belt is designed to move around the main suction chamber for picking up the flat articles, one by one. A pair of transfer belts are positioned for transferring the flat articles as they are delivered from the suction belt, the transfer belts pinching the articles therebetween. An intake belt is provided between the suction belt and the transfer belts and is tilted by an angle $\theta$, with respect to the flat article transfer direction. Or, fins may be mounted on a roller which supports the intake belt in order to push bent tip ends into alignment. The speed $V_1$ of the intake belt or fins is set equal to $V_1 \geqq (V_2/\cos \theta)$.

BRIEF DESCRIPTION OF THE DRAWINGS

This invention will now be described in detail with reference to the accompanying drawings, in which.

DESCRIPTION OF THE PREFERRED EMBODIMENTS

Figure 1:
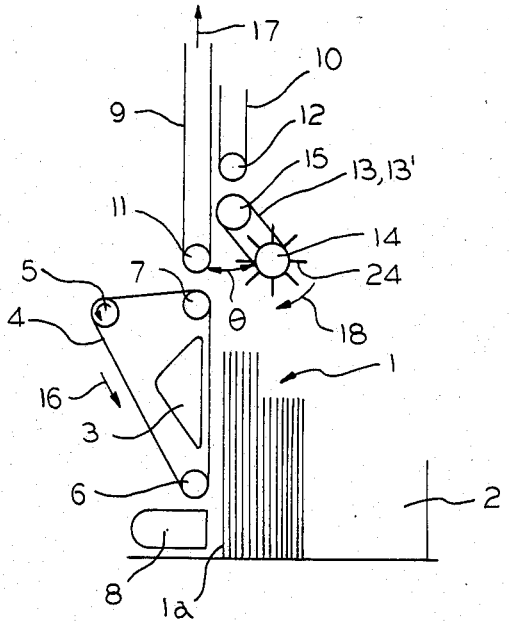
FIG. 1 is a top plan view of an embodiment of this invention.
Figure 2:
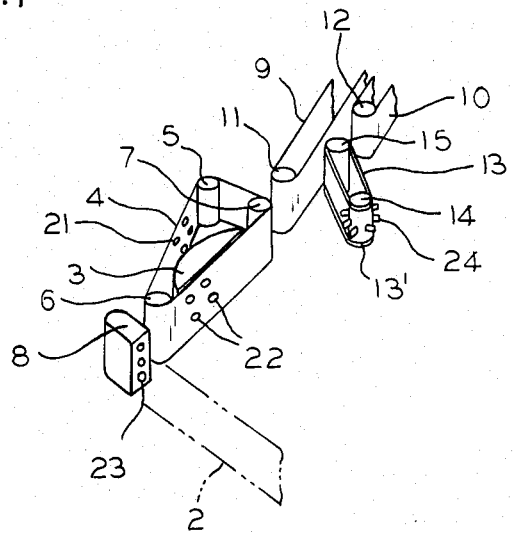
FIG. 2 is a perspective view of the flat article feeding apparatus illustrated in FIG. 1.

Referring to FIGS. 1 and 2, flat articles 1 to be fed out are accumulated in a standing state in a stacker 2. A main suction chamber 3 is provided at a side confronting the sides of the flat articles 1. The main suction chamber 3 has a flat side containing air suction holes on a flat article side, and chamber 3 is connected to a vacuum pump (not shown). Three rollers 5, 6 and 7 are arranged around the perimeter of the main suction chamber 3 and have an endless perforated suction belt 4, which surround the main suction chamber 3. The perforated suction belt 4 has pierced holes 21 and 22 (FIG. 2), at a certain pitch, which are designed to move around the main suction chamber 3 in a direction 16.

When the belt 4 comes to a position at which the holes 21 or 22 of the suction belt 4 are aligned with the air suction holes of the main suction chamber 3, the left most (as viewed in FIG. 1) flat article 1a is delivered from the stacker 2, and is fed out toward a transfer belt 9 and intake belts 13 and 13'.

An auxiliary suction chamber 8 is provided below the roller 6 to prevent a simultaneous feed-out of flat articles by forming a suction against a trailing end or tail tip of the next flat article in stack 1.

The description will proceed next to a flat article transferring structure. A pair of transfer belts 9 and 10 are entrained respectively on rollers 11 and 12, and extend in a direction identical with the flat article feeding direction 17. The pair of transfer belts 9 and 10 are designed to pinch therebetween and to carry the flat article as it is delivered from the suction belt 4 and to transfer it in forward direction 17.

As is clearly seen in the drawings, of these two transfer belts, the transfer belt 9 extends further than the other transfer belt 10 extends toward suction belt 4. As can be best seen in FIG. 2, two intake belts 13 and 13' are entrained around a pair of rollers 14 and 15 in the vicinity of the upper and lower ends of the rollers. The belts 13 and 13' are arranged to open outwardly from belt 9 by an angle $\theta$ (FIG. 1), with respect to the flat article feed-out direction 17 so as to enlarge the entrance to the space between belts 9, 10.

Figure 3:
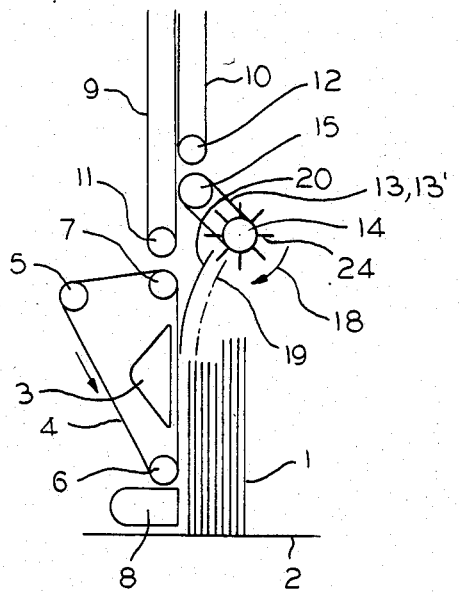
FIG. 3 is another top plan view for explaining the operations of the present invention.

The roller 14 near the suction belt 4 feed-out part is adapted to rotate the belts 13 and 13' in a direction 18 in FIG. 1. Roller 14 has a plurality of fins 24 extending perpendicularly from its peripheral surface. The fins 24 are provided to push the leading end or tip of the flat article toward the transfer belt 9 (see FIG. 3).

With such a construction, the moving speed of the intake belts 13 and 13' is set to be equal to or more than (1/cos $\theta$) times as fast as the transfer speed, i.e., the moving speed of the suction belt 4 or the transfer belts 9 and 10. The respective rollers 5, 11, 12 and 14 are driven by drive means (not shown).

In operation, the flat articles accumulated in the stacker 2 are fed out, one by one, in accompanyment with the rotation of the suction belt 4. After this, the flat article carried by belt 4 is guided by the fins 24 or the intake belts 13 and 13', and is finally transferred through the transfer belts 9 and 10 to a next handling process station.

When the fed flat article is bent at the leading end or tip (FIG. 3), the tip reaches the fins 24 or the intake belts 13 and 13', as indicated by flat articles 19 and 20, in accompanyment with the rotation of the suction belt 4. In the case of the flat article 19, the leading end or tip of the flat article is pushed toward the transfer belt 9 by the fins 24 on the roller 14, which rotates more rapid than the moving speed of the perforated suction belt 4. Thus, the flat article can be transferred to the transfer belts 9 and 10 without pressure being exerted at the leading end or tip of the flat article. On the other hand, in the case of the flat article 20, the leading end or tip of the flat article is in contact with the belts 13 and 13'. Since the speed of these belts 13 and 13' is (1/cos $\theta$) times as fast as the speed of the suction belt 4, the flat article can be also transferred to the transfer belts 9 and 10 without the pressure being exerted at the leading end or tip of the flat article.

As described in the foregoing specification, the invention contributes to an improvement in flat articles handling by providing a flat article feeding apparatus which can stably feed out flat articles without multilating them and without misoperation, or a jamming of the flat article, even when the fed out flat article is bent or apt to bend at its leading end or tip.

Those who are skilled in the art will readily perceive how to modify the invention. Therefore, the appended claims are to be construed to cover all equivalent structures which fall within the true scope and spirit of the invention.

What is claimed is:

1. A stacker-loader for converting a stack of parallel flat articles into a sequential series of said flat articles, said stacker-loader comprising means for accumulating a stack of said flat articles in a standing parallel position, suction belt means with a flat section confronting said stack of flat articles, said suction belt means forming a vacuum pick up means for sequentially moving the flat articles, one by one, from said stack and into a transport path, a confronting pair of running belts positioned to receive said flat articles as said suction belt means move them into said transport path, and intake means at the junction of said suction belt means and said confronting pair of running belts, said intake means comprising a belt set at an angle of $\theta$ with respect to said transport path for guiding and directing said flat articles as they enter said transport path, the speed $V_1$ of said intake belt and the speed $V_2$ of said confronting belts having a relationship of $V_1=(V_2/\cos\theta)$.

2. The stacker-loader of claim 1 wherein the end of said intake belt nearest said suction belt means is trained around a post having a finned roller thereon, said finned roller directing the leading end of said flat article into the angle between the confronting belt and said intake belt.

3. The stacker-loader of claim 1 wherein one of said confronting belts is longer than another of said confronting belts in the area of said suction belt, thereby leaving an area on said longer belt which is unopposed by said shorter belt, and said intake belt means fits into said unopposed area whereby said intake belt cooperates with said longer belt to form said angle $\theta$.

4. The stacker-loader of claim 3 wherein the end of said intake belt nearest said suction belt means is trained around a post having a fined roller thereon, said finned roller directing the leading end of said flat article into the angle between the confronting belt and said intake belt.

5. The stacker-loader of claim 4 and suction means nearest the trailing edge of said stack of flat articles for clinging to a flat article behind the article picked up by said suction belt means to preclude a dual pick-up.

6. A flat article feeding apparatus comprising:

stacker means for positioning at best one flat article in a standing position;

suction chamber means having a side confronting said standing position;

a perforated suction belt movable around said suction chamber means for delivering said flat article from said standing position in said stacker means in a transfer direction responsive to the movement of said suction belt;

a first belt disposed adjacently to an end point in said transfer direction of said perforated suction belt and moving in said transfer direction, the speed of said first belt being substantially equal to the speed of said perforated suction belt;

a second belt engaging with said first belt for transferring said flat article in said transfer with holding said flat article therebetween, a start point in said transfer direction of said second belt being distant from said end point of said perforated suction belt, the speed of said second belt being substantially equal to that of said first belt; and a third belt disposed on the opposite side of said first belt and at the preceding position of said second belt between said end point of said perforated suction belt and said start point of said second belt, said third belt being positioned at an angle with respect to said transfer direction to spread an intake area receiving said flat article delivered by said perforated suction belt, the speed of said third belt being faster than the speed of said first and second belts.

7. A flat article feeding apparatus as claimed in claim 6, further comprising intake fins provided on a peripheral surface of a roller shaft which extrains said third belt.

8. A flat article feeding apparatus comprising:

a stacker means for positioning at least one flat article in a pick up position;

suction chamber means confronting said pick up position;

a perforated suction belt movably trained around said suction chamber means for delivering said flat article from said pick up position in said stacker means to an output position responsive to the movement of said perforated suction belt;

a first belt following said output position of said perforated suction belt, the speed of said first belt being substantially equal to the speed of said perforated suction belt;

a second belt engaging with said first belt for transferring said flat article with holding it therebetween, said second belt being located in distance from said output position of said perforated suction belt; and finned means positioned between said second belt and said perforated suction belt for pushing the leading end of said flat article delivered by said perforated suction belt toward to said first belt, the moving speed of said finned means being faster than the speed of said perforated suction belt.

* * * * *